US007862091B2

(12) United States Patent
Escobar

(10) Patent No.: US 7,862,091 B2
(45) Date of Patent: Jan. 4, 2011

(54) ELECTROMECHANICAL DOOR SOLENOID CURRENT SURGE BOOSTER CIRCUIT

(75) Inventor: Miguel A. Escobar, North Hollywood, CA (US)

(73) Assignee: Command Access Technology, LLC, Fullerton, CA (US)

( * ) Notice: Subject to any disclaimer, the term of this patent is extended or adjusted under 35 U.S.C. 154(b) by 314 days.

(21) Appl. No.: 11/248,940

(22) Filed: Oct. 11, 2005

(65) Prior Publication Data

US 2006/0082162 A1 Apr. 20, 2006

Related U.S. Application Data

(60) Provisional application No. 60/618,019, filed on Oct. 12, 2004.

(51) Int. Cl.
*E05B 65/10* (2006.01)

(52) U.S. Cl. ..... 292/93; 292/201

(58) Field of Classification Search ..... 292/144, 292/201; 70/278.1, 279
See application file for complete search history.

(56) References Cited

U.S. PATENT DOCUMENTS 3,643,479 A * 2/1972 Solow ..... 70/241
4,220,022 A * 9/1980 Willach ..... 70/271
5,879,036 A * 3/1999 Moline et al. ..... 292/210

* cited by examiner

*Primary Examiner*—Gary Estremsky
(74) *Attorney, Agent, or Firm*—Philip H. Haymond

(57) ABSTRACT

An apparatus, circuit and method for operating a solenoid-actuated electromechanical door latching mechanism that includes a capacitor to meet the power surge requirements needed to move a door latching mechanism. A power supply at one end of a transmission line is coupled with a capacitor adjacent the solenoid at the other end of the transmission line to reduce the need for a larger capacity power, heavy gauge transmission lines and increases the distance at which a power supply may be located from a door latching device.

18 Claims, 5 Drawing Sheets

ELECTROMECHANICAL DOOR SOLENOID CURRENT SURGE BOOSTER CIRCUIT

CROSS REFERENCE TO RELATED APPLICATION

This patent application claims priority to U.S. Provisional Patent Application No. 60/618,019 filed on Oct. 12, 2004, entitled Electromechanical Door Solenoid Current Surge Booster Circuit, which is incorporated herein by reference.

FIELD OF THE INVENTION

This invention relates to electromechanical door opening devices and more particularly to a method and apparatus for a supplying power to an electromechanical door latch actuator.

BACKGROUND OF THE INVENTION

Electromechanical security door lock mechanisms actuated by solenoids are ubiquitous. A typical lock mechanism allows a user on one side of a door to mechanically actuate the locking mechanism to release the lock while requiring a user on the other side of the door to actuate it electromechanically with a security device such as a key, a card reader, or a keypad requiring that a password, number or word be entered.

Panic exit devices, for example, employ a mechanical latch release mechanism that allows a user on the egress side of a door to mechanically actuate the mechanism as a fail-safe release for the door latch to allow exit from a room. The Von Duprin company of Indianapolis, Ind. makes several such devices and related components such as their 33A/35A and 98/99 Series Exit Devices. A panic exit device may also be equipped to be actuated electromechanically with a solenoid to allow a person on the opposite ingress side of the door to operate the latching mechanism electrically. A user attempting to operate the latching mechanism from the ingress side might be required to use an electronic security device to gain access such as a card reader or keypad to electromechanically release the latch mechanism. The Sargent Manufacturing Company of New Haven, Conn. makes various electromechanical latching devices using a solenoid actuator, their Series 80 product line is similar to that of the Von Duprin 33A/35A and 98/99 Series products. In some applications the egress latching mechanism may be operated by employing an electromechanical latching mechanism as well, using a solenoid to operate the latching mechanism.

These electromechanical latching devices use a solenoid to actuate the latching mechanism in the door, to move it from a first closed or locked position to a second open or unlocked position. Solenoids are widely used operate a variety of electromechanical door latch configurations. The above panic exit devices for example may be configured to be used with a latching mechanism that includes vertical rods, roller (horizontal) rods, or with rim or mortised types of latching mechanisms. Exemplary prior art designs for latching devices and components of analogous construction are shown in Zawadski U.S. Pat. No. 3,767,238 entitled Push Plate Panic Exit Device and Godec et al, U.S. Pat. No. 4,167,280 entitled Panic Exit Mechanism.

These electromechanical door latching mechanisms require a separate power supply to supply current to operate the solenoid. A typical power supply for a solenoid of the prior art is located at a distance from the latching mechanism on the door itself. A typical power supply is a transformer used to convert 120 or 220 VAC input current to a safe 24 VDC output current to operate the solenoid at its required current load. The solenoids used with these devices require a substantial momentary current load for an interval of time to move the latching mechanism.

A solenoid used in door latches typically include primary and secondary coils that move an armature or plunger and hold the armature of the solenoid in the moved position. The armature is connected to a latching mechanism and the primary solenoid coil causes the armature to move the latching mechanism from a first locked or closed position to a second unlocked or open position. The secondary coil thereafter retains the armature and latching mechanism in the unlocked configuration. Latching mechanisms are typically biased with a spring to return the latching mechanism to the closed or locked position after power to the secondary coil is removed.

The primary coil of a solenoid for a door actuator is typically operated for a load interval of about 10-200 msec at 20-30 VDC, depending on the solenoid being used. The secondary coil requires only perhaps half an ampere at to retain the latching mechanism in an unlocked configuration thereafter.

These devices have proved very useful and successful over the years. Panic exit and security entry devices are a critical part of any fire and safety system and providing restricted access and safe and reliable egress from a building in the event of a fire or power failure. Such devices are frequently required by local fire safety and building codes.

A longstanding problem with the prior art is that the power supply for the latching mechanism must be able to supply power at an acceptably safe lower voltage and with sufficient current to meet the inrush surge current load drawn during actuation of the primary coil of the solenoid. Because the current must be maintained at a safer lower typically 24 VDC voltage to prevent electrocution, the effects of resistance and voltage drop are increased in the transmission of power from the power supply to the solenoid over a transmission wire. Because the output voltage of the power supply must be kept low the effects of resistance and particularly voltage drop in the wire connecting the power supply to the solenoid must be minimized.

Voltage drop is also increased as the power supply is located at greater distances from the solenoid, this requires that the power supply be situated relatively close to the solenoid. Typically the transmission wire connecting the power supply to the door latch solenoid cannot exceed more than twenty-five feet in length and therefore presents an inherent design limitation.

Voltage drop and resistance are also proportional to wire size and the voltage drop in connecting transmission wire has been minimized in the prior art by using a larger gauge wire to connect the power supply to the solenoid. Standard 18-gauge electrical wiring used in buildings is usually unsuitable for carrying the needed momentary current surge load between the power supply and the solenoid of a door latch mechanism so heavier gauge wiring, 12-gauge wire for example, is typically used instead. This heavier wire must be specially installed in the walls between the power supply and the solenoid of the door. The need to install heavier gauge wiring to carry current between the power supply and the door solenoid is costly and laborious.

What is needed then is a way to reduce voltage drop in the transmission wire without the necessity of using heavier gauge wire and without the necessity the need for the power supply be in such close proximity to the solenoid. This would allow for a wider choice of locations for the power supply and be more economical as well because a lighter gauge wire may be used.

Further objects and advantages of the invention will become apparent to one skilled in the art by reading and understanding the following summary, detailed description and the drawings to which it refers.

SUMMARY OF THE INVENTION

A solution to the above has been devised. The power supply is located on one end of the transmission wire and a capacitor connected to the solenoid is located on the other end of the transmission wire, adjacent to the door latching mechanism. The capacitor provides a current reserve that may be drawn on when the primary coil is activated, greatly reducing the current capacity needed to be carried over the transmission wire. This current boost by the capacitor allows sufficient additional current to be delivered to the solenoid to momentarily operate the primary coil to move the latching mechanism from a locked to an unlocked position.

In the preferred embodiment the booster circuit of the present invention includes the capacitor and circuitry to monitor voltage in the system and to time and switch the primary coil on and off. The booster circuit is located on the door, close to or directly adjacent the solenoid. The problem of voltage drop due to the distance between the power supply and solenoid is thus reduced.

The use and placement of a booster circuit in this manner decreases the need for heavier gauge wiring and to have the power supply located so close to the door. Because the power supply may be located at a greater distance from the latching mechanism a wider variety of design choices is allowed for placing the power supply. Voltage drop is much less of a problem because the transmission line current load is less. The capacitor and secondary coil are charged with a relatively steady current from the power supply and the secondary coil only draws about half an ampere. The power supply and transmission wire then need only be suitable for carrying current sufficient to charge the capacitor and power the secondary coil.

In the preferred embodiment the circuitry used to control the capacitor includes a micro controller that monitors the voltage charge of the capacitor and times a primary coil ignition delay cycle beginning from when the power supply is activated. The power supply may be switched on when a user presses on the panic bar or when a security device such as a keypad is used to switch on the power supply.

For a given solenoid and latching mechanism a capacitor must reach an optimum voltage charge to ensure there is sufficient reserve current for proper solenoid operation. The capacitor must achieve at least a minimum voltage to operate the solenoid at all and the optimum voltage is generally higher than the minimum voltage. When the power supply is turned it both charges the capacitor and the secondary coil of the solenoid. The micro controller measures the increasing voltage of the charge on the capacitor over time and, when the capacitor either reaches the predetermined optimum voltage, or, when a preset ignition delay time period has elapsed together with the capacitor having at least reached the predetermined minimum voltage, the micro controller switches on the primary coil for a set period of time, the load interval. Current from the capacitor supplements the current supplied by the power supply to provide the boost needed to meet the increased current load drawn by the primary coil, to move the door latching mechanism to the open or unlocked position.

The circuit does not switch on the primary coil of the solenoid at all unless the threshold minimum voltage has been reached.

After the primary coil has been supplied with current for a preset brief load interval period of time the micro controller switches off the primary coil and the capacitor recharges. When the power supply current is removed the micro controller causes the capacitor to fully discharge, by briefly activating the primary coil for example. This final discharge of the capacitor is performed to prevent the reserve current in the capacitor from continuing to supply power to the secondary coil after the power supply has been removed, and thereby hold the latching mechanism in an open or unlocked position after the power supply has been removed. The capacitor would continue to supply power to the solenoid as its charge dissipates.

After the power supply current has been removed and the capacitor has been sufficiently discharged the latching mechanism returns to a closed or locked position.

This construction allows for door latching operation without the need for a higher capacity power supply that must be in such close proximity to the latching mechanism and without the need for the use of a larger gauge transmission wire. The use of the present invention allows the power supply to be placed at much greater distances from the latching mechanism, perhaps 250 feet, allowing a wider choice of power supply locations. The elimination of the need for heavier gauge wiring is particularly useful for retrofitting electromechanical door latching devices in existing buildings because existing smaller transmission wire may be used.

Use of a micro controller in the booster circuit also allows the device of the present invention to be programmed to be used with a multitude of existing door actuating devices and panic exit devices made by different manufacturers. The minimum and optimum voltage charge levels, as well as the ignition delay before switching on the primary coil, may be adjusted for properly supplying power to a given solenoid.

In this respect, before explaining at least one embodiment of the invention in detail it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

The following detailed description, and the figures to which it refers, are provided for the purpose of describing example(s) and specific embodiment(s) of the invention only and are not intended to exhaustively describe all possible examples and embodiments of the invention.

Figure 1B:
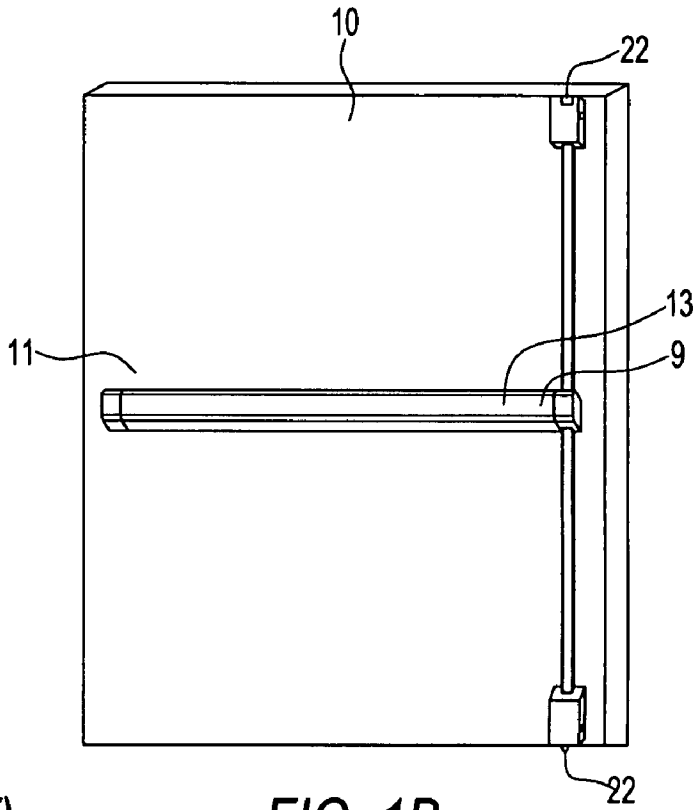
FIG. 1B (PRIOR ART)
FIGS. 1A and 1B are front perspective views of latching mechanisms of the prior art that may be used in conjunction with the present invention.
Figure 1A:
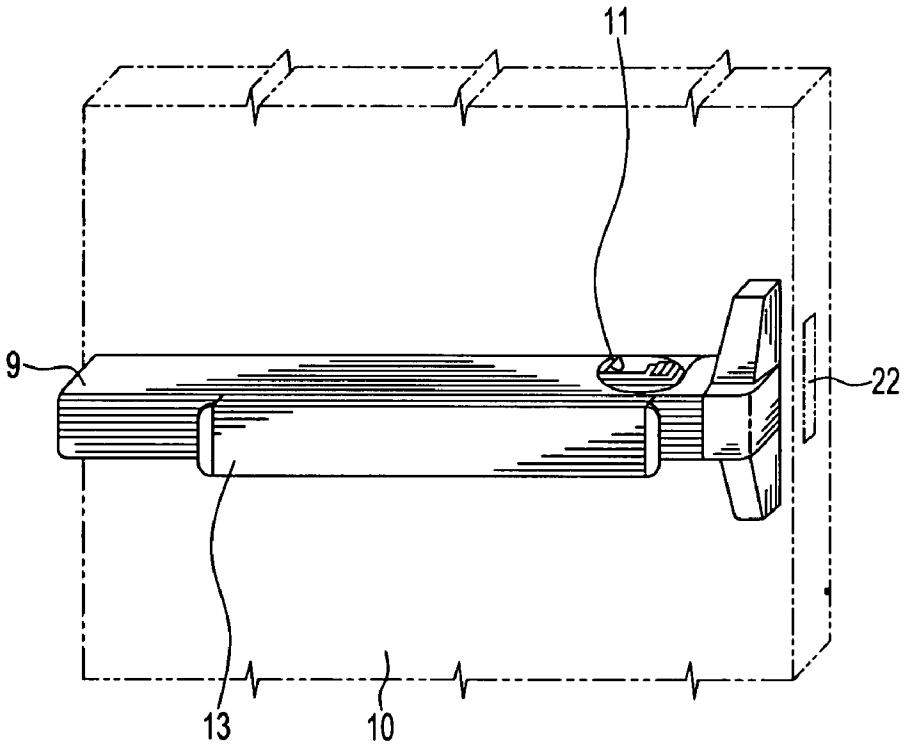
Figure 1C:
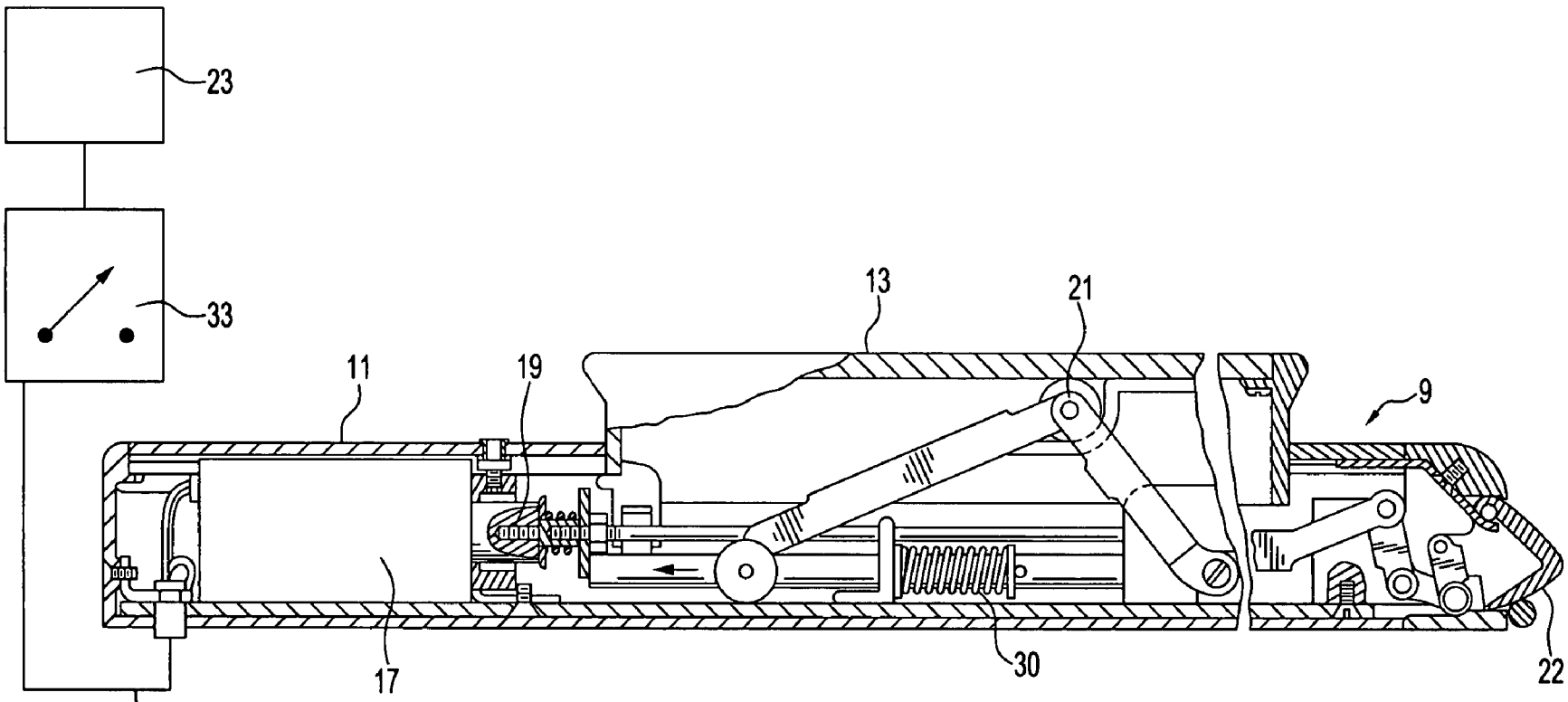
FIG. 1C (PRIOR ART)
FIG. 1C is a schematic view of an electromechanical door latching device of the prior art that is used with the devices of FIGS. 1A and 1B.

Referring now to FIGS. 1A, 1B and 1C front and schematic views are shown of the general attributes of typical latching devices of the prior art with which the present invention may be used. FIG. 1A is a view of a mortise type latching mechanism actuated by a touch plate that is mounted on a portion of a door; FIG. 1B is a view of a vertical rod type of latching mechanism. FIG. 1C is a side schematic view of a rim type latching mechanism. These different types of door latching mechanisms are presented by way of example to display the variety of latching mechanisms used and not so as to limit the scope of the invention. The present invention may be used with other electromechanical door latching configurations incorporating a solenoid, such as horizontal roller door latching mechanisms.

Panic exit door latching device 9 has a housing 11 mounted on a door 10 and having a touch plate 13 supported for movement outwardly and inwardly that is coupled to a switch (not shown) to activate a latch bolt actuator assembly 21. The touch plate 13, when pressed, actuates a two-stage solenoid 17, having primary and secondary coils (not shown) that move an armature 19 linked to the latch bolt actuator mechanism 21. In the first stage the primary coil the of solenoid 17 retracts the solenoid armature 19. The armature 19 is coupled to the latch bolt actuator assembly 21 providing an operative connection between the armature of the solenoid and a locking bolt 22.

This first stage of operation of moving the armature of the solenoid requires a substantial electrical current draw from a power supply 23. Power from the power supply 23 is switched on with high current relay switch 33. A typical power supply 23 is rated to momentarily supply several amperes at 24 VDC or twice that amount at 12 VDC to actuate the solenoid. Thereafter in a second hold stage the secondary coil of the solenoid holds the latch in a retracted state until such time as it has been programmed or timed to release. A security device such as a keypad or a card reader may be used in conjunction with operation of the circuit if the door latching device 9 to allow selective access through the door.

Electrical current is supplied to the solenoid 17 with transmission wiring 16 that is threaded through the device and the interior of the door itself to a separate power supply 23. The wiring to a typical separate power supply 23 requires the use of 16 heavier gauge transmission wire than is ordinarily used for standard electrical circuits in a building. 12-gauge wire is typically used owing to the substantial electrical current draw needed by the solenoid for the first stage of the latch opening process. In the second stage of the latch opening process the solenoid armature is retained in the open position by a secondary coil requiring much less current.

Figure 2A:
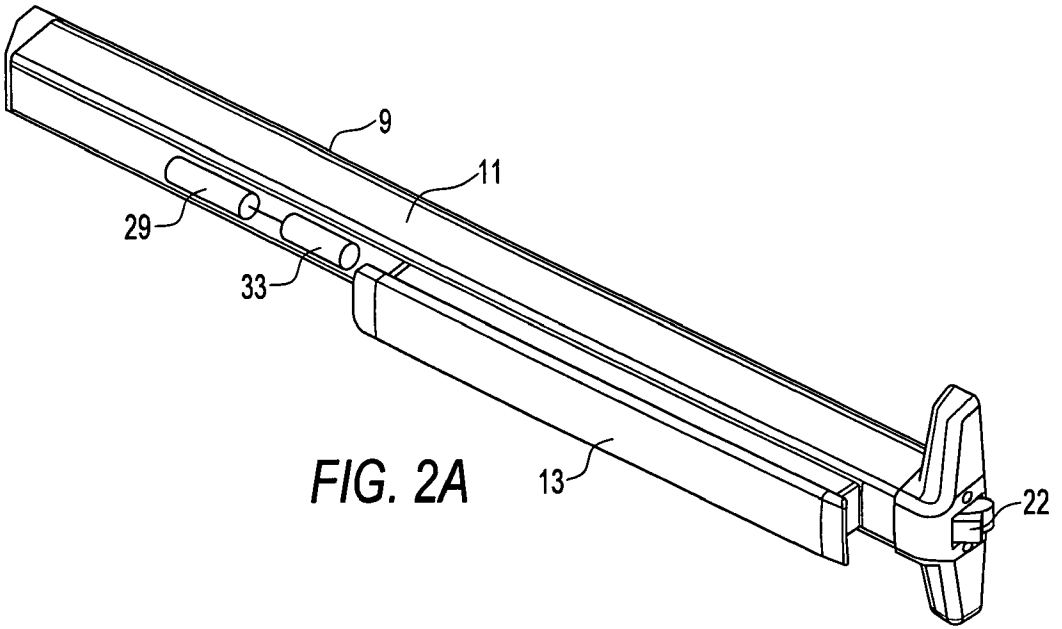
FIG. 2A is a perspective view of an embodiment of an electromechanical door latching device of the present invention.
Figure 2B:
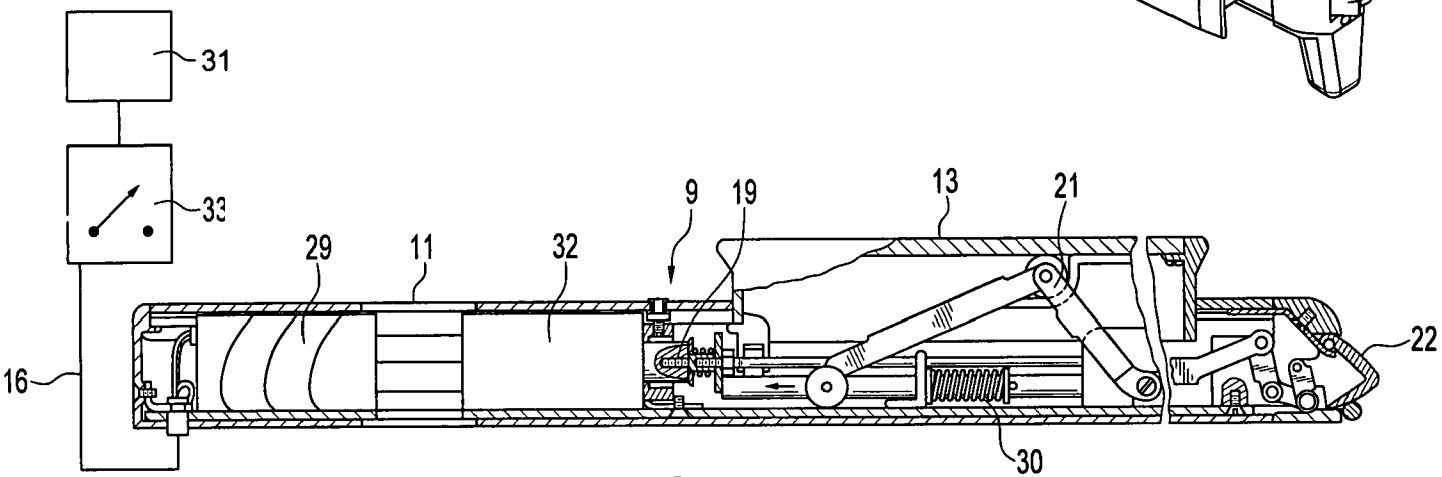
FIG. 2B is a schematic view of an embodiment of an electromechanical door latching device of the present invention.

FIG. 2A is a perspective view of an embodiment of an electromechanical door latching device using a booster circuit of the present invention. A rim type of panic exit door latching device 9 of including the present in invention is shown. The capacitor 29 is mounted within the housing 11 and is in electrical communication with the solenoid 17. FIG. 2B is a schematic view of an embodiment of the invention as used with the panic exit door latching device of FIG. 2A. No special high capacity power supply is needed and instead a smaller power supply 31 may be used. In most applications a power supply of at least about 1-2 amperes capacity is sufficient. In a typical application the supply voltage is about 20-30 VDC.

In the preferred embodiment the circuit monitoring the charge of the capacitor includes a 68HC908QT2 micro controller made by the Motorola corporation of Santa Clara, Calif. This micro controller includes 1.5K bytes of in-application reprogram able flash ROM and 128K bytes of RAM. Standard assembly code is used to program a timed cycle with the micro controller to monitor the voltage of the capacitor as it is charged and discharged and to fully discharge the capacitor to fully deactivate the solenoid at the end of the cycle.

Figure 3:
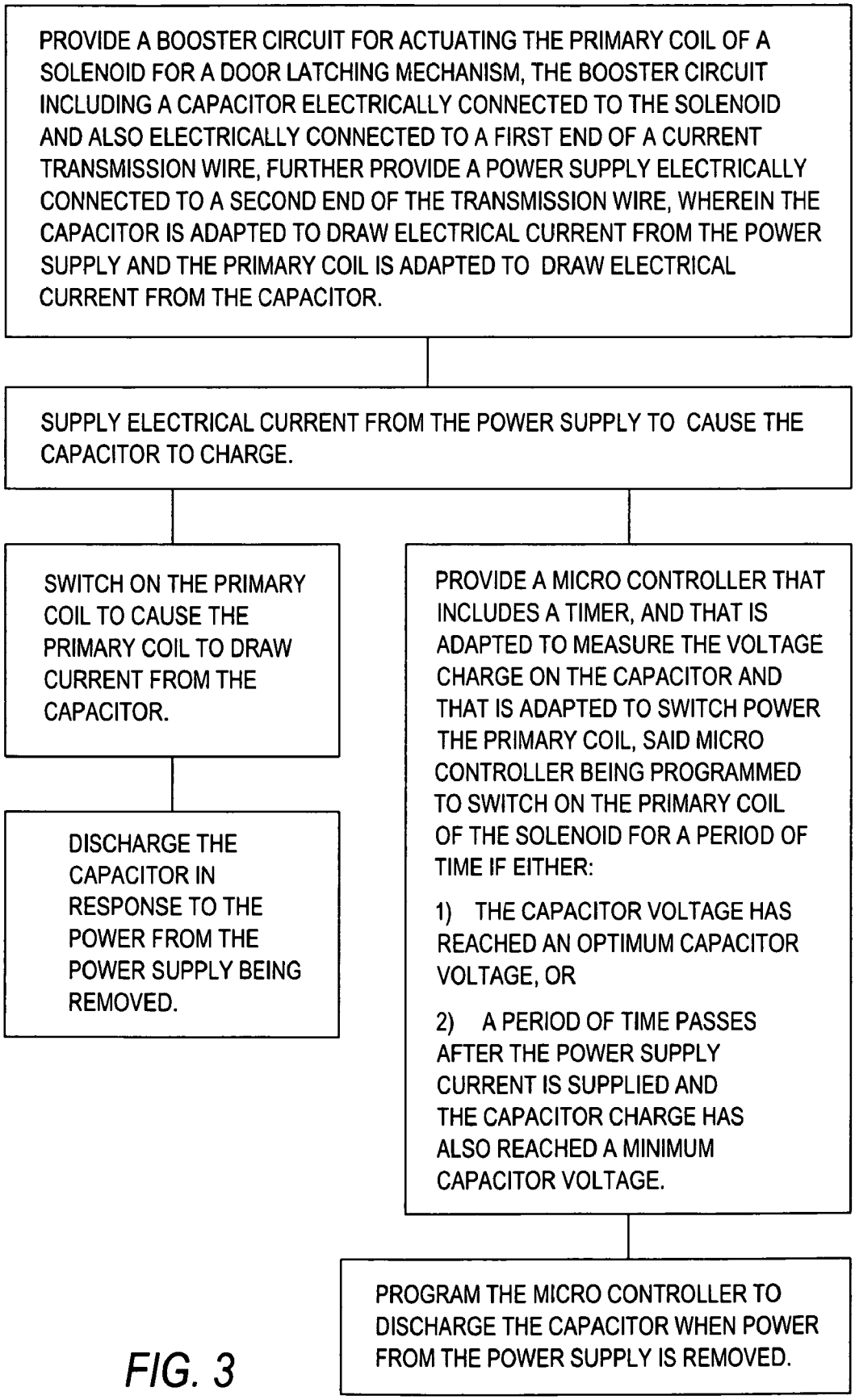
FIG. 3 is a flow chart of methods of the present invention.

The method of the present invention is shown in FIG. 3. The micro controller of the booster circuit is programmed to switch on the primary coil of the solenoid after one of two conditions exists. The micro controller will switch on the primary coil either when the capacitor voltage reaches the threshold of a preset optimum voltage charge, 22 VDC in this embodiment, or if a minimum capacitor voltage, 20 volts in this embodiment, has been reached and also a maximum ignition delay period of time has elapsed after the power supply is activated, after half a second in this embodiment. The micro controller then switches the primary coil off after a preset period of time, the load interval, in this embodiment about 100 msecs.

If the minimum voltage has not been reached the primary coil will not be switched on.

The micro controller is further programmed to fully discharge the capacitor after current from the power supply is removed, in this embodiment by switching the primary coil on again, to prevent the secondary coil from remaining on from current remaining in the capacitor.

Voltage drop loss in the wiring between the power supply 31 and the latching device 9 is no longer a significant problem with the method and design of the present invention. A smaller gauge wire may be used for the wiring between the power supply 16 as well, eliminating the need for special retrofitting of the electrical system of a building.

Figure 4:
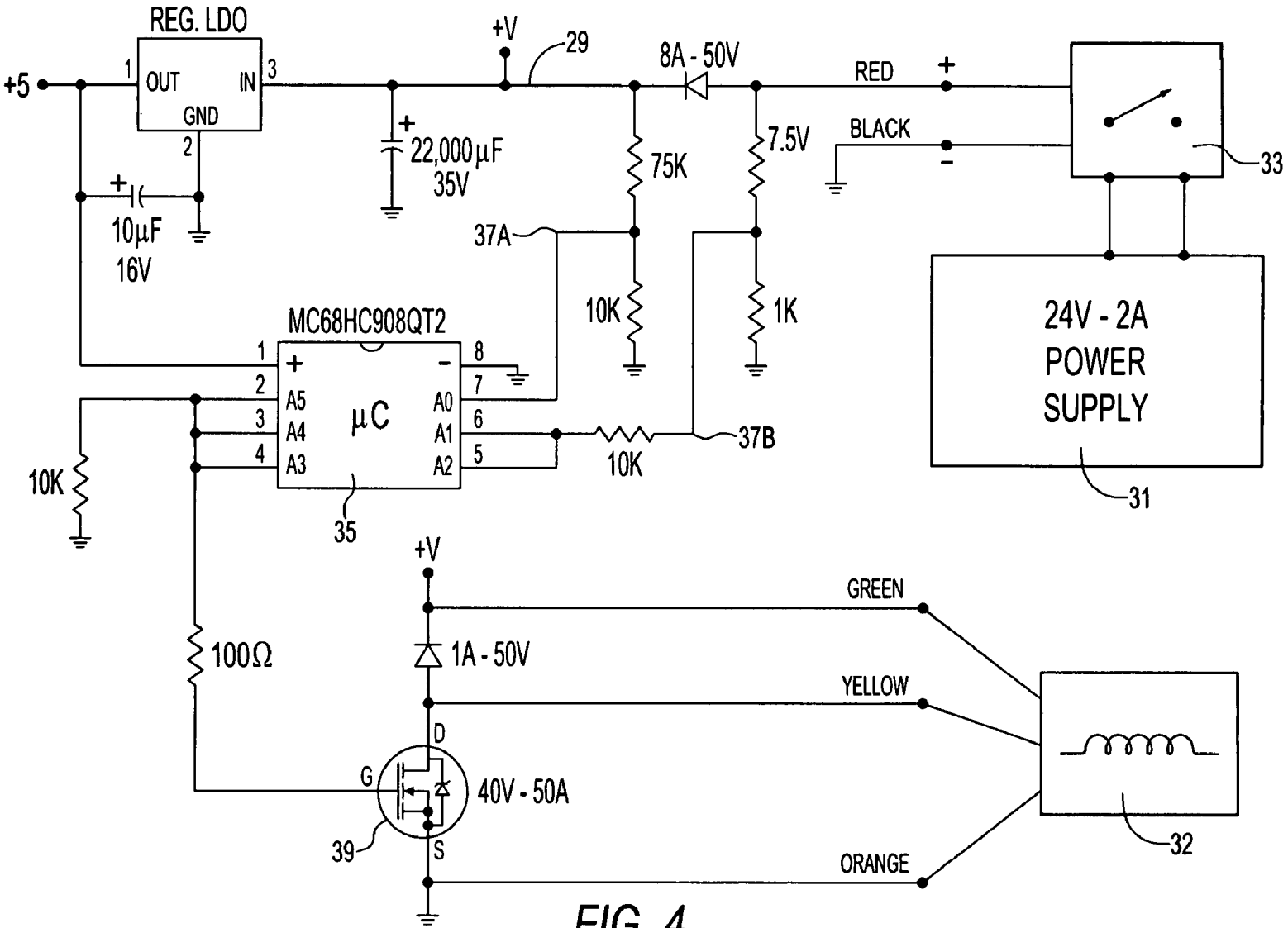
FIG. 4 is a circuit diagram of an embodiment of the present invention.

FIG. 4 is a circuit diagram of a preferred embodiment of the circuit of the invention, to be used with generally available latching devices. FIG. 4 is a preferred embodiment of the circuit of the present invention and designed to work with Von Duprin types of electric latch retractors, such models EL 33 and EL 99. A 24 VDC power supply 31 supplies current to a high current relay switch 33. The switch 33 may be mechanical or an electronic equivalent, such as an electronic switch implemented with a Metal-oxide semiconductor field-effect transistor (MOSFET). The capacitor 29 is sized to be used with a particular model, in this example a 22,000 microfarad capacitor with 35 volts maximum is used.

Because the circuit includes a programmable micro controller 35, the circuit can be programmed to accommodate the specific characteristics of a specific latching mechanism having a capacitor of a given size. In this embodiment the micro controller monitors the charge on the capacitor, shown here at voltage divider checkpoints 37A and 37B corresponding to inputs A0 and A2 of the micro controller 35 in the circuit of FIG. 4, by measuring the rate of increase in capacitor charge voltage over time. The micro controller 35 switches on the primary coil of the solenoid with driver 39 either when the capacitor reaches a preset optimum capacitor voltage, or when a half second ignition delay has elapsed and the capacitor has reached at least a preset minimum voltage, supplying the solenoid 32 with a boost or reservoir of current for the primary coil draw on to retract the latching mechanism from a default locked configuration to an open configuration. In the open configuration the latching mechanism is typically tensioned by spring 30 (shown in FIG. 2B) or other retraction mechanism to return it to the default closed position. During the load interval the micro controller times the discharge of the capacitor supplying the solenoid and switches off the primary coil after a set period of time, 100 msecs in this embodiment. When power from the power supply is removed, the micro controller again switches on the primary coil in order to fully discharge the capacitor.

It will be appreciated that the invention has been described hereabove with reference to certain examples or preferred embodiments as shown in the drawings. Various additions, deletions, changes and alterations may be made to the above-described embodiments and examples without departing from the intended spirit and scope of this invention. Accordingly, it is intended that all such additions, deletions, changes and alterations be included within the scope of claims to this invention.

The invention claimed is:

1. A powered door latch mounted on a security door, comprising:

a transformer that supplies electrical current to a door latch through a transmission wire, a mechanical latch bolt actuator that moves a locking bolt that is affixed to a security door, including a capacitor that is electrically connected to a solenoid, the solenoid is mechanically coupled to the locking bolt, and the locking bolt is moved by electrical current supplied to the solenoid by the capacitor, and the transformer is located at a distance of more than twenty-five feet away from the capacitor.

2. The powered door latch of claim 1, further including a computer, where the charging and discharging of the capacitor is controlled by the computer.

3. The powered door latch of claim 2, where the computer is a micro controller.

4. The powered door latch of claim 2 where the computer has been programmed to cause the discharge of the capacitor to be sufficient to allow the door actuator to move from a first closed position to a second open position by measuring the voltage of the capacitor and switching on the capacitor either when the capacitor reaches a preset optimum capacitor voltage or when a preset ignition delay has elapsed and the capacitor has reached at least a preset minimum voltage.

5. The powered door latch of claim 1 further including a security device, where the circuit controlling the charging and discharging of the capacitor to move the locking bolt requires that the security device be successfully negotiated by a user.

6. The powered door latch of claim 2 further including a security device, where the circuit controlling the charging and discharging of the capacitor to move the locking bolt requires that the security device be successfully negotiated by a user.

7. An electrical circuit for controlling a powered door latch for mounted on a security door, comprising:

an electrical circuit controlling a mechanical latch bolt actuator that moves a locking bolt that is affixed to a security door from a closed position to an open position, where the locking bolt is moved by a solenoid that is mechanically coupled to the locking bolt, a capacitor is electrically connected to the solenoid and also to a transformer by a current transmission wire, where the capacitor is adapted to draw electrical current from the transformer and the solenoid is adapted to draw electrical current from the capacitor, and the transformer is located at a distance of more than twenty-five feet away from the capacitor.

8. The circuit of claim 7, further including a computer, where the charging and discharging of the capacitor is controlled by the computer.

9. The circuit of claim 8, where the computer is a micro controller.

10. The circuit of claim 8, where the computer has been programmed to cause the discharge of the capacitor to be sufficient to allow the door actuator to move from a first closed position to a second open position by programming the computer to allow the capacitor to discharge only when either the capacitor voltage either reaches an optimum level for the solenoid it is used with, or when the capacitor voltage reaches a minimum level and the capacitor has charged for a minimum time interval.

11. The circuit of claim 7, further including a security device, where the circuit controlling the charging and discharging of the capacitor to move the locking bolt requires that the security device be successfully negotiated by a user.

12. The circuit of claim 8, further including a security device, where the circuit controlling the charging and discharging of the capacitor to move the locking bolt requires that the security device be successfully negotiated by a user.

13. A method for operating a powered door latch mounted on a security door that is powered by a transformer that supplies electrical current to the door latch through a transmission wire, comprising the steps of:

providing a door latch that is affixed to a security door having a mechanical latch bolt actuator that moves a locking bolt from a closed position to an open position, where the locking bolt is moved by a solenoid that is mechanically coupled to the locking bolt, a capacitor is electrically connected to the solenoid and also to a transformer by a current transmission wire, wherein the capacitor is adapted to draw electrical current from the transformer and the transformer is located at a distance of more than twenty-five feet away from the capacitor and the solenoid is adapted to draw electrical current from the capacitor;

supplying electrical current from the transformer to cause the capacitor to charge, and causing the solenoid to draw current from the capacitor and thereby move the locking bolt to the open position.

14. The method of claim 13, where the capacitor is discharged to cause the solenoid to draw current by removing the power supplied from the transformer .

15. The method of claim 13 further including a computer that controls the charging and discharging of the capacitor and the computer is programmed to cause the solenoid to draw current from the capacitor by measuring the voltage of the capacitor and switching on the capacitor either when the capacitor reaches a preset optimum capacitor voltage or when a preset ignition delay has elapsed and the capacitor has reached at least a preset minimum voltage .

16. The method of claim 15 where the computer is a micro controller.

17. The method of claim 15 where the computer is programmed to remove the power from the transformer to cause the capacitor to discharge.

18. The powered door latch of claim 3 where the micro controller has been programmed to cause the discharge of the capacitor to be sufficient to cause the door actuator to move from a first closed position to a second open position by programming the micro controller to measure the voltage of the capacitor and switch on the capacitor either when the capacitor reaches a preset optimum capacitor voltage or when a preset ignition delay has elapsed and the capacitor has reached at least a preset minimum voltage.

* * * * *